United States Patent [19]

Reich

[11] 4,206,604

[45] Jun. 10, 1980

[54] ROTARY STIRLING CYCLE MACHINE

[76] Inventor: Steven Reich, 1330 W. Ridgeway Ave., Waterloo, Iowa 50701

[21] Appl. No.: 897,496

[22] Filed: Apr. 18, 1978

[51] Int. Cl.[2] ..... F02G 1/04

[52] U.S. Cl. ..... 60/518; 60/519

[58] Field of Search ..... 60/517, 518, 519, 520, 60/525, 526; 62/6; 418/151

[56] References Cited

U.S. PATENT DOCUMENTS

| | | | |
|---|---|---|---|
| 1,319,456 | 10/1919 | Bingham | 418/151 X |
| 3,377,846 | 4/1968 | Castelet | 418/151 X |
| 3,483,694 | 12/1969 | Huber | 60/519 |
| 3,509,718 | 5/1970 | Fezer | 60/519 |
| 3,800,526 | 4/1974 | Wahnschaffe | 60/519 |
| 3,936,248 | 2/1976 | Fritzsche | 418/150 X |

*Primary Examiner*—Allen M. Ostrager
*Attorney, Agent, or Firm*—Zarley, McKee, Thomte, Voorhees & Sease

[57] ABSTRACT

A rotary Stirling cycle machine is disclosed comprising at least two chambers, said chambers being epitrochoidal in cross-sectional area and having an upper portion, a middle waist portion and a lower portion, with the first chamber mounted to the second chamber in tandem, each chamber having a seal element attached to the waist portion and disposed inwardly, the crank shaft rotatably mounted within the chambers and extending therethrough with the first crank throw portion within the first chamber being 180° out of phase with the second crank throw portion within the second chamber, the first and second rotor elements rotatably mounted on said respective crank throw portions with each rotor element being limicon shaped in circumference and adapted to register with the upper and lower portions of the respective chambers so that the rotor elements cyclically rotate about the rotating crank shaft from a position in registration with the upper portion to a position in registration with the lower portion, said seal elements being in constant sealing engagement with the respective rotor elements to define first cavities in the upper portions and second cavities in the lower portions, and heater-regenerator-cooler means operatively connected to said first and second cavities to condition a working fluid through repeated Stirling cycles.

16 Claims, 10 Drawing Figures

ROTARY STIRLING CYCLE MACHINE

BACKGROUND OF THE INVENTION

This invention relates to a Stirling cycle machine and more particularly to a rotary Stirling cycle machine capable of functioning as either a prime mover or a refrigerator. Prior Stirling cycle machines suffered from thermal conduction problems between the expansion and compression chambers, complex costly malfunction prone sealing elements, impractical large overall physical size in relation to output, and high production costs due to high tolerance requirements.

SUMMARY OF THE INVENTION

A rotary Stirling cycle machine is disclosed comprising at least two chambers, said chambers being epitrochoidal in cross-sectional area and having an upper portion, a middle waist portion and a lower portion, with the first chamber mounted to the second chamber in tandem, each chamber having a seal element attached to the waist portion and disposed inwardly, the crank shaft rotatably mounted within the chambers and extending therethrough with the first crank throw portion within the first chamber being 180° out of phase with the second crank throw portion within the second chamber, the first and second rotor elements rotatably mounted on said respective crank throw portions with each rotor element being limicon shaped in circumference and adapted to register with the upper and lower portions of the respective chambers so that the rotor elements cyclically rotate about the rotating crank shaft from a position in registration with the upper portion to a position in registration with the lower portion, said seal elements being in constant sealing engagement with the respective rotor elements to define first cavities in the upper portions and second cavities in the lower portions, and heater-regenerator-cooler means operatively connected to said first and second cavities to condition a working fluid through repeated Stirling cycles. The first and second cavity of the first chamber comprise the hot expansion chamber and the first and second cavities of the second chamber comprise the cold compression chambers for the Stirling cycle to provide inherent thermal separation in addition to the thermal insulating element between the first and second chambers. Conditioning the working fluid through repeated Stirling cycles causes the machine to function as a prime mover while, in the converse application, the application of rotational force to the crank shaft causes the heater-regenerator-cooler means to function as a refrigerator as the working fluid repeats the Stirling cycle.

An alternate embodiment discloses the first chamber rotatably mounted to the second chamber whereby rotation allows selective variance of the system's power output. Another alternate embodiment comprising four chambers mounted in tandem such that the crank throws of the first and fourth chambers are 180° out of phase with the crank throws of the second and third chambers to inherently balance the system.

It is a principal object of this invention to provide an improved rotary Stirling cycle machine.

A further object of the invention is to provide a rotary Stirling cycle machine that functions as a prime mover.

A still further object of the invention is to provide a rotary Stirling cycle machine that functions as a refrigerator.

A still further object of the invention is to provide a method for using a rotary Stirling cycle machine as a prime mover.

A still further object of the invention is to provide a method for using a rotary Stirling cycle machine as a refrigeration device.

A still further object of the invention is to provide a rotary Stirling cycle machine having thermal separation of the expansion and compression working chambers.

A still further object of the invention is to provide a rotary Stirling cycle machine having improved sealing characteristics.

A still further object of the invention is to provide a rotary Stirling cycle machine having stationary, simplified sealing elements in the rotor housing.

A still further object of the invention is to provide a rotary Stirling cycle machine providing substantially internal balancing.

A still further object of the invention is to provide a rotary Stirling cycle machine having a reduced overall physical size in relation to the equivalent displacement of a reciprocating engine.

A still further object of the invention is to provide a rotary Stirling cycle machine that is adapted to die cast housing including the inner surfaces thereof.

A still further object of the invention is to provide a rotary Stirling cycle machine having a hot expansion chamber with a ceramic inner surface.

A still further object of the invention is to provide a rotary Stirling cycle machine providing efficient sealing of the high pressure working fluid from atmospheric pressure.

A still further object of the invention is to provide a rotary Stirling cycle machine which allows variation of system power output by selective rotation of the respective disposition of the chamber housings. A still further object of the invention is to provide a rotary Stirling cycle machine that has low production tolerance requirements. A still further object of the invention is to provide a rotary Stirling cycle machine that is economical to manufacture, durable in use and refined in appearance.

BRIEF DESCRIPTIONS OF THE DRAWINGS

DESCRIPTION OF THE PREFERRED EMBODIMENT

Figure 1:
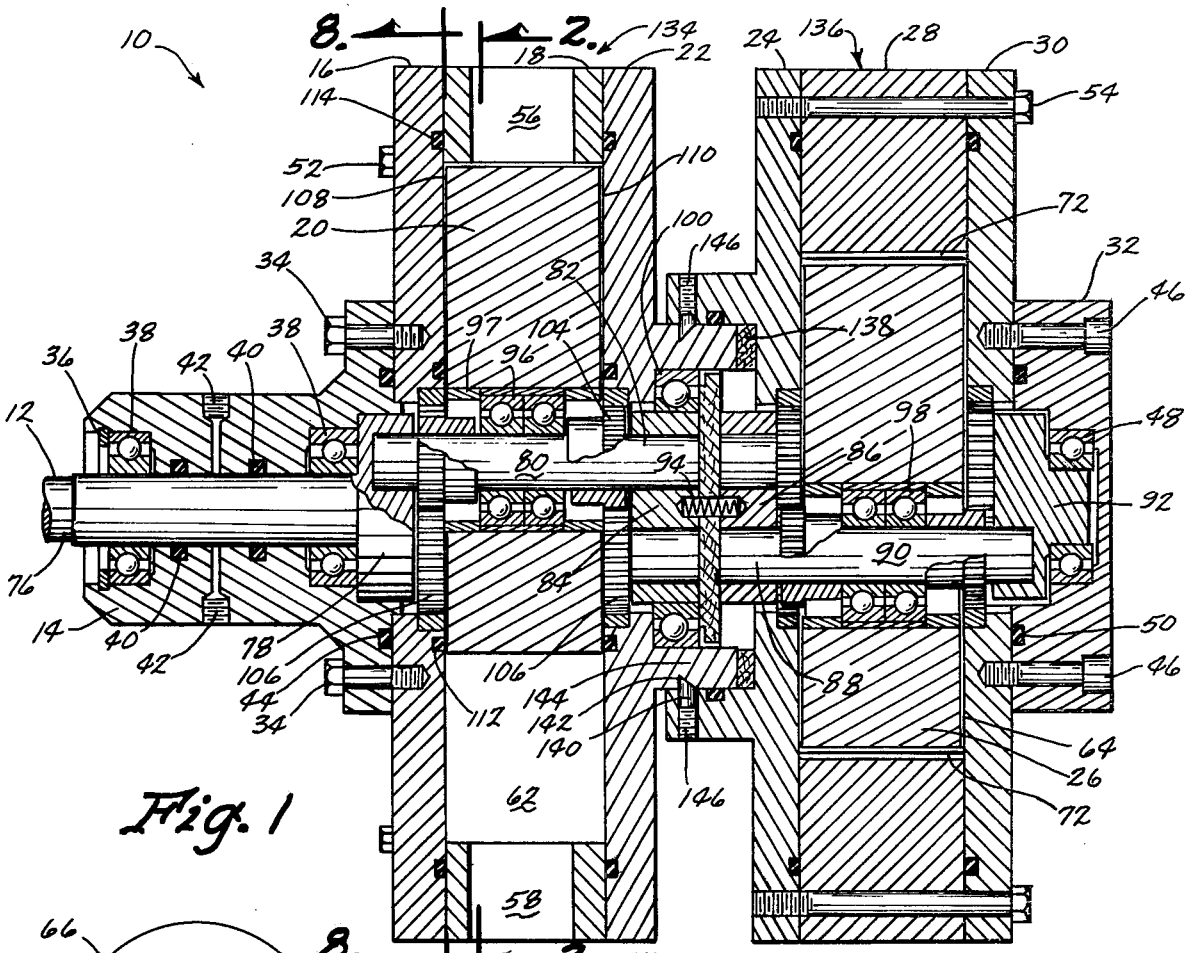
FIG. 1 is a partially broken away sectional side view of the invention.
Figure 3:
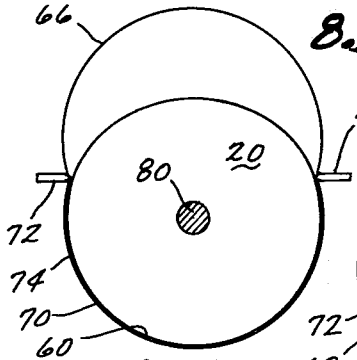
FIGS. 3 through 5 are schematic views similar to FIG. 2 illustrating the cyclic rotation of the rotor element.

The rotary Stirling cycle machine of the present device is generally denoted by the numeral 10 and is shown in the FIG. 1.

Rotary machine 10 generally comprises crank shaft 12, front bearing housing 14, front rotor housing cover 16, front rotor housing 18, front rotor element 20, front rotor housing cover 22, rear rotor housing cover 24, rear rotor element 26, rear rotor housing 28, rear rotor housing cover 30 and rear bearing housing 32 (see FIG. 1).

Front bearing housing 14 is securely attached to front rotor housing cover 16 by bolts 34 and contains bearing retaining rings 36, crank shaft bearings 38, seals 40, grease packing inlets 42, and seal 44. In a similar manner, rear bearing housing 32 is securely attached to rear rotor housing cover 30 by bolts 46 and comprises rear bearing 48 and seal 50.

Bolt 52 securely connects front rotor housing cover 16 to front rotor housing 18 and rear rotor housing cover 22 as does bolt 54 securely connect housing cover 24 and housing 28 to housing cover 30.

Figure 2:
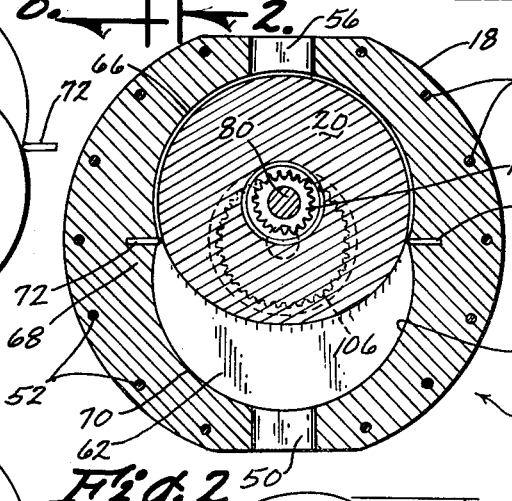
FIG. 2 is a reduced sectional view seen on line 2—2 of FIG. 1.
Figure 5:
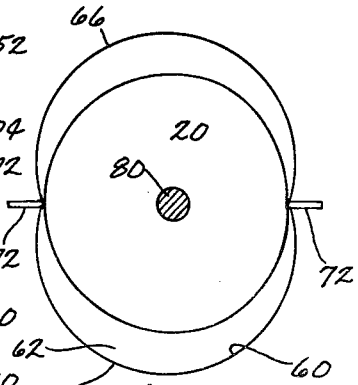
Figure 4:
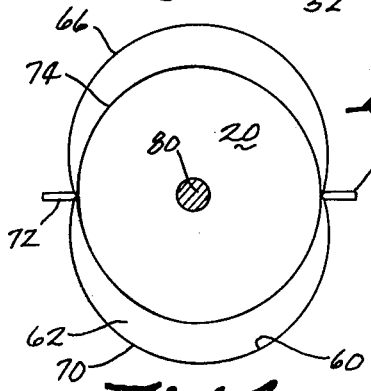
Figure 8:
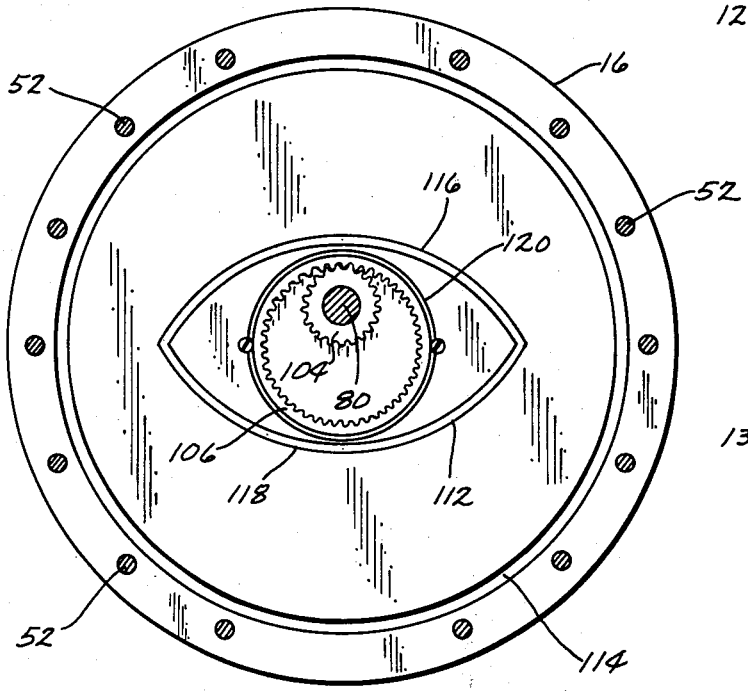
FIG. 8 is a slightly reduced sectional view seen on line 8—8 of FIG. 1.

Front rotor housing 18 has two opposing ports 56 and 58 and an interior contour or surface 60 having a figure 8 shaped cross-section as shown in FIG. 2. The figure 8 configuration will hereinafter be referred to as "epitrochoidal". Covers 16 and 22 together with surface 60 form chamber 62. Ports 56 and 58 provide fluid communication with chamber 62. In a likewise manner, chamber 64 is formed between covers 24 and 30 and the interior surface of rear rotor housing 28. Rotor housing 18 is divided into upper portion 66, waist portion 68 and lower portion 70 with seal 72 being mounted adjacent waist portion 68 and inwardly disposed relative to chamber 62. Chamber 64 is likewise constructed and will not be further described although it should be noted that in FIG. 1 covers 24 and 30 and housing 28 are rotated 90° with respect to covers 16 and 22 and housing 18 thereby disposing chamber 64 90° from chamber 62. The relative disposition of the chambers will be discussed in more detail hereinafter.

Figure 6:
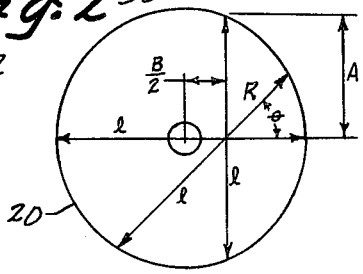
FIG. 6 is a mathematical schematic view of the geometry of the rotor configuration.

Rotor 20 is intended to function as an internal axis planetary rotating piston; that is, rotor 20 is given planetary rotation around crank shaft 12 and at the same time is constrained to rotate about the crank throw portion of crank shaft 12 by a gear system. The geometry of the profile of rotor 20 is illustrated in FIG. 6 and is described in polar coordinates as:

$$R = A - B \cos \theta$$

where R equals the radius vector length from the origin to the rotor surface, $\theta$ equals the angle from the x axis, A and B are constants. The distance 1 is defined by the equation $$1 = (A - B \cos \theta) + (A - B \cos (\theta + \pi))$$

For R equal to a constant value, the profile of rotor 20 becomes a circle of radius R.

However, a circular rotor requires that the sealing elements attached to the waist portion of the housing be movable inwardly and outwardly in order to maintain contact with the rotor surface as the rotor rotates between the upper and lower portions of chamber 62. A spring loaded blade system being yieldable to the travel of the circular rotor provides the necessary lateral movement.

However, seal 72 can be maintained stationary and thereby greatly simplified in construction by utilization of a limicon shaped rotor as shown in FIG. 6. The combination of a limicon shaped rotor 20 and a stationary seal 72 is preferred. By utilizing a limicon shaped rotor, the contact point of the seal is constant and the seal 72 is in constant sealing engagement with the circumferential rotor surface 74, as illustrated in FIGS. 2 through 5 showing the various positions of rotor 20 in relation to surface 60 during one complete cycle.

The rotor housing contour must have enough clearance to allow the rotor to rotate therein without interference, but for the best volumetric efficiency the housing contour should be as close as possible to the rotor contour in the top (FIG. 2) and bottom (FIG. 3) dead center positions. Since the rotor does not rub or engage the inside surface, the epitrochoidal shaped housing can be made as a die casting with no machining being necessary since they are not used for sealing. This greatly simplifies construction and reduces production costs. Also, because the rotor does not engage the inside surface, a separate liner of ceramic or some other castable refractory material can be cast into the rotor housing to be used for the hot expansion chamber of the Stirling cycle thereby allowing higher operating temperatures with little heat loss. This will increase efficiency and will reduce heat transfer problems experienced in prior Stirling cycle machines. Conversely, the housing for the cool compression chamber of the Stirling cycle could be constructed of aluminum for better cooling and lighter weight.

Crank shaft 12 is comprised of exterior portion or output shaft 76, crank shaft cheek 78, crank throw portion 80, crank pin 82, crank cheek 84, crank cheek 86, crank pin 88, crank throw portion 90, and crank shaft cheek 92 (FIG. 1). Spring 94 separates crank cheek 84 from crank cheek 86. Rotor 20 rotates about crank throw portion 80 via rotor bearings 96 while rotor 26 rotates about crank throw portion 90 via rotor bearings 98. Center bearing 100 provides the central support for crank pin 82 and crank pin 88.

External gears 104 and rotor gear bushing 97 are mounted on each side of rotor 20 (FIGS. 1 and 2) and gears 104 engage internal gears 106 (FIGS. 1 and 2) mounted to covers 16 and 22 (FIGS. 1 and 8) to constrain rotor 20 to rotate about crank throw portion 80. As a planetary rotation machine, the rotor is given planetary rotation about the crank shaft and at the same time is constrained to rotate about the crank throw portion by the gear system.

To provide sealing for the gas pressures attained in the compression and expansion chambers, the rotor 20 is sealed at its perimeter by stationary tip seal 72 and at each face or surface 108 and 110 by side or gas seals 112 and 114 (FIGS. 1 and 8). Side seal 114 is an O-ring type configuration while side seal 112 resides in circular grooves 116 and 118 shown in FIG. 8. Seal 112 is preferably made of Rulon (tradename of a filled polytetrafluoroethylene), with a lip (not shown) that faces outward from grooves 116 and 118 so as to allow gas pressure to force it against the rotor in an application of low system output. The seal acts in either direction since the pressure differential alternates to either side as will be described in more detail subsequently. Oil seal 120 is located between side seal 112 and internal gear 160.

Figure 9:
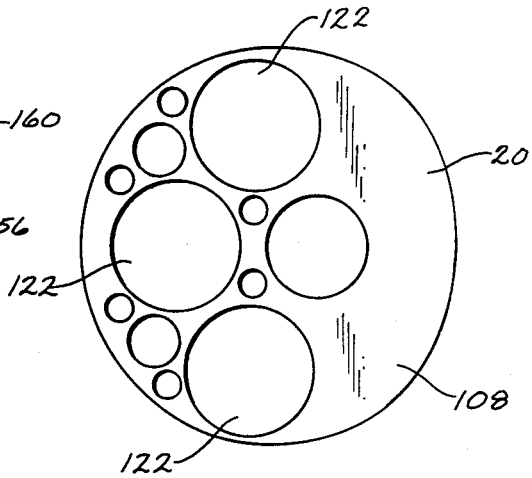
FIG. 9 is a sectional view illustrating the balancing of the rotor element.

Primary balancing of machine 10 is accomplished by disposing crank throw portion 80 180° from crank throw portion 90. Because the rotors are limicon shaped with the center of mass not coincidental with the center of rotation around the respective crank throw portions, a secondary balancing problem exists due to the orbiting rotors. This problem is eliminated by moving the center of mass of the rotor to coincide with the center of rotation around the crank throw by machining round holes 122 therethrough to provide a matrix as shown in FIG. 9. These holes are then covered to form cavities within the rotor and the sides or faces 108 and 110 of the rotor are ground flat.

Figure 10:
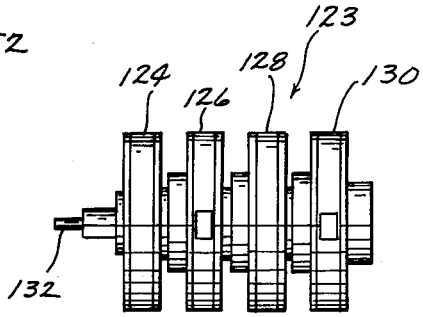
FIG. 10 is an alternate embodiment of FIG. 1 showing four rotor housings in tandem.

There is also an unbalanced couple rotating at crank speed caused by the crank throws and rotors being axially displaced along the crank shaft. This can be counterbalanced by weights mounted on the crank shaft external to the engine. External balancing can be eliminated, however, by the alternate embodiment 123 of machine 10 shown in FIG. 10. Machine 123 comprises four rotor housings 124, 126, 128 and 130 connected in tamden at 90°. The crank throw portions (not shown) of crank shaft 132 reside in the same plane with the crank throw portions of housings 126 and 128 being 180° out of phase from the crank portions of housings 124 and 130. The engine is thus balanced without the need of external balancing weights.

Returning to the basic two rotor design of machine 10, forward rotor housing assembly 134 is thermally insulated from rear rotor housing assembly 136 by inherent physical separation and thermal insulation elements 138. With thermal insulating elements 138 separating housing assembly 134 being the hot expansion chamber from housing assembly 136 being the cold compression chamber of the Stirling cycle, effective thermal insulation is obtained and efficiency of the Stirling cycle is greatly increased.

Selective variance of the system output is obtained by rotatably mounting housing assembly 134 to housing assembly 136. This is accomplished by bevel pin 140 being pressed in groove 142 of flange 144 by set screw 146 (FIG. 1). Bevel pin 140 is thereby held by set screw 146 in groove 142 and channel 148 of flange 150. Housing assembly 136 may then be selectively rotated relative to housing assembly 134 by loosening the opposing set screws 146, rotating the housings and retightening the set screws. Acceptable power output is obtained by disposing the longitudinal axis of chamber 62 90° from the longitudinal axis of chamber 64. However, 90° is not necessarily the optimum angle for a Stirling cycle machine and the rotatable mounting of housing assembly 136 to housing assembly 134 allows selective variance for optimum results.

The operation of machine 10 is best described by reference to the schematic diagram shown in FIG. 7. Numerals corresponding to their respective elements of FIG. 1 are utilized where possible. Forward rotor housing assembly 134 contains the hot expansion chamber 62. The continuous sealing engagement of tip seal 72 with rotor 20 and side seal 112 further divides chamber 62 into an upper or first cavity 152 and a lower or second cavity 154 with port 56 providing fluid communication to cavity 152 and port 58 providing fluid communication to cavity 154.

Figure 7:
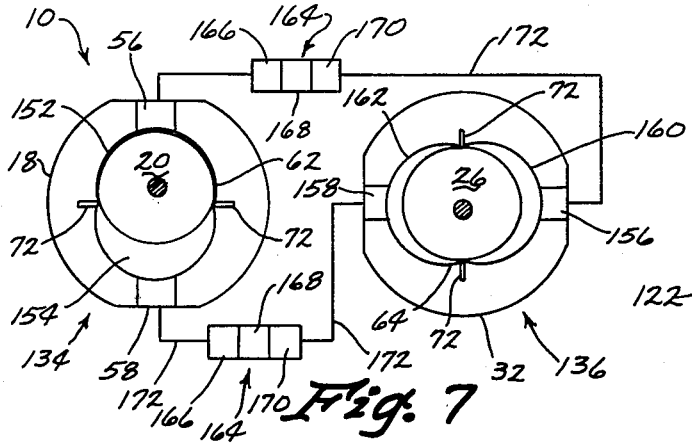
FIG. 7 is a schematic view of the operation of the invention.

Rear rotor housing assembly 136 contains the cool compression chamber 64 schematically shown in FIG. 7 rotated 90° from chamber 62. Ports 156 and 158 provide fluid communication through rear rotor housing 32 to chamber 64. In a manner identical to forward rotor housing assembly 134, the seals and rotor 26 form upper or first cavity 160 and lower or second cavity 162. Port 156 provides fluid communication to first cavity 160 and port 158 provides fluid communication to second cavity 162.

A double acting engine is preferred because it has two power strokes for each piston and therefore has half as many moving parts for the same power output. In this regard, expansion chamber first cavity 152 is operationally connected to compression chamber first cavity 160 and expansion chamber second cavity 154 is operationally connected to compression chamber second cavity 162 to achieve this action. The inherent thermal separation of the hot expansion chamber 62 from the cool compression chamber 64 is clearly illustrated by the schematic of FIG. 7. Heater-regenerator-cooler means 164 comprising a conventional heater element 166, a regenerator element 168 and a cooler element 170 is needed for each pair of compression-expansion cavities. Suitable conduit 172 fluidly connects the heater-regenerator-cooler means 164 to the respective ports to allow fluid communication of the working fluid between the respective expansion-compression cavities. During operation of machine 10 as a prime mover, heater-regenerator-cooler means 164 will condition the working fluid through repeated Stirling cycles to produce power output on crank shaft 12. During operation of machine 10 as a refrigeration device, power will be supplied to crank shaft 12 and heater-regenerator-cooler means 164 will function as a heat exchange refrigeration device in a conventional manner.

The physical operation of machine 10 will be described for the Stirling cycle of the working fluid in expansion first cavity 152 and compression first cavity 160 with the understanding that the exact same operation is occurring with respect to expansion second cavity 154 and compression second cavity 162 but out of phase as is conventionally done in double acting engines.

The Stirling cycle in cavities 152 and 160 operates as follows: The gas on the cold compression side (cavity 160) is at low pressure. It is transferred to the hot side (152) at constant volume. In transferrance to the hot side, the gas is heated first by regenerator 168 and secondly by heater 166. No work is done in the transfer as no volume change is taking place. As the hot gas begins to expand, work is being done on both pistons. After the gases have expanded against the pistons, the gas is transferred back to the cool side. In this respect, the gas is just transferred and not compressed. As it is transferred back to the cool side, heat is extracted from the hot gas first by the regenerator and then by the cooler, this heat being rejected to the surroundings. Since the cool gases are at a lower pressure, the work required to compress the gas to its minimum volume is less than the work performed by the high pressure gases expanding against the pistons previously. The cool gas at a low pressure is now compressed and the cycle starts over again by transferring the cool compressed gas over to the hot side where it is heated upon transferance. The Stirling cycle is continually repeated, resulting in the rotation of the rotor element through the various positions shown in FIGS. 2 through 5, producing power output on crank shaft 12. Thus, machine 10 functions as a prime mover.

Machine 10 can also function as a refrigeration device by merely reversing the process. By applying rotational power to crank shaft 12 through a motor or other conventional means, the heat element 166 would become a refrigeration coil and the cooler element 170 would become a heat rejection coil, resulting in a refrigeration device.

Thus, it can be seen that rotary Stirling cycle machine 10 accomplishes at least all of its stated objectives.

What is claimed is:

1. A rotary Stirling cycle machine comprising, at least two chambers, being a first chamber and a second chamber, said first chamber being epitrochoidal in cross sectional area and having an upper portion, a middle waist portion and a lower portion, said second chamber being epitrochoidal in cross sectional area and having an upper portion, a middle waist portion and a lower portion, said second chamber being mounted to said first chamber, a first seal means attached to said waist portion of said first chamber and inwardly disposed, a second seal means attached to said waist portion of said second chamber and inwardly disposed, a crankshaft rotatably mounted within said first and second chambers and extending therethrough, said crankshaft having a first crank throw portion within said first chamber and a second crank throw portion within said second chamber, said first crank throw portion being 180° out of phase with said second crank throw portion, first and second rotor elements adapted to register with said upper portions and said lower portions of said first and second chambers, respectively, said first rotor element being rotatably mounted to said first crank throw portion so that said first rotor element cyclically rotates about said first crank throw portion from a position in registration with said upper portion to a position in registration with said lower portion to return to a position in registration with said upper portion, said second rotor element being rotatably mounted to said second crank throw portion so that said second rotor element cyclically rotates about said second crank throw portion from a position in registration with said upper portion to a position in registration with said lower portion to return to a position in registration with said upper portion, said first seal means being in constant sealing engagement with said first rotor element to define a first cavity in said upper portion of said first chamber and a second cavity in said lower portion of said first chamber, said second seal means being in constant sealing engagement with said second rotor element to define a first cavity in said upper portion of said second chamber and a second cavity in said lower portion of said second chamber, and first and second heater-regenerator-cooler means to condition a working fluid through repeated Stirling cycles, said first heater-regenerator-cooler means operatively connected to said first cavities of said first and second chambers and said second heater-regenerator-cooler means operatively connected to said second cavities of said first and second chambers, said first chamber being rotatably mounted to said second chamber to permit selective variance of the angle between the longitudinal axis of said first chamber and the longitudinal axis of said second chamber for selective control of power output of said machine when said machine is operated as a prime mover.

2. The machine of claim 1 wherein said first chamber is mounted to said second chamber so that the longitudinal axis of said first chamber forms a 90° angle with the longitudinal axis of said second chamber.

3. The machine of claim 1 wherein said first chamber is rotatably mounted to said second chamber to permit selective variance of the angle between the longitudinal axis of said first chamber and the longitudinal axis of said second chamber for selective control of power output of said machine when said machine is operated as a prime mover.

4. The machine of claim 1 wherein said first and second cavities of said first chamber comprise expansion chambers and said first and second cavities of said second chamber comprises compression chambers in a Stirling cycle.

5. The machine of claim 4 wherein a thermal insulating means is interposed between said first and second chambers to prevent thermal transfer therebetween.

6. The machine of claim 5 wherein said thermal insulating means comprises an insulating disk element mounted between said first and second chambers.

7. The machine of claim 1 wherein said first and second rotor elements are circular in circumference profile.

8. The machine of claim 7 wherein said first and second seal means comprise first and second seal elements and first and second yieldable mounting means for mounting said first and second seal elements to said waist portion to allow yieldable outward lateral displacement of said seal elements in correspondence with the cyclic rotation of said rotor elements so that said first and second seal elements maintain constant sealing engagement with said first and second rotor elements, respectively.

9. The machine of claim 1 wherein said first and second rotor elements are limicon shaped in circumference.

10. The machine of claim 9 wherein said first and second seal means comprise first and second stationary seal elements, respectively, mounted to said waist portions of said first and second chambers.

11. The machine of claim 9 wherein the center of rotation of said rotor elements about said respective crank throw portions is coincident with the center of mass of said rotor elements.

12. The machine of claim 11 wherein said rotor elements comprise balancing cavities therein to fix the center of mass at the center of rotation.

13. The machine of claim 1 further comprising, a third chamber being epitrochoidal in cross sectional area and having an upper portion, a middle waist portion, and a lower portion, said third chamber mounted to said second chamber, a fourth chamber being epitrochoidal in cross sectional area and having an upper portion, a middle waist portion and a lower portion, said fourth chamber being mounted to said second chamber, said first, second, third and fourth chambers being interconnected in tandem, a third seal means attached to said waist portion of said third chamber and inwardly disposed, a fourth seal means attached to said waist portion of said fourth chamber and inwardly disposed, said crankshaft extending through said third and fourth chambers and rotatably mounted therein, said crankshaft having a third crank throw portion within said third chamber and a fourth crank throw portion within said fourth chamber, said first, second, third and fourth crank throw portions residing in a common plane with said third crank throw portion being in phase with said second crank throw portion and said fourth crank throw portion being in phase with said first crank throw portion, third and fourth rotor elements adapted to register with said upper and said lower portions of said third and fourth chambers, respectively, said third rotor element being rotatably mounted to said third crank throw portion so that said third rotor element cyclically rotates about said third crank throw portion from a position in registration with said upper portion of said third chamber to a position in registration with said lower portion of said third chamber to return to a position in registration with said upper portion, said fourth rotor element being rotatably mounted to said fourth crank throw portion so that said fourth rotor element cyclically rotates about said fourth crank throw portion from a position in registration with said upper portion of said fourth chamber to a position in registration with said lower portion of said fourth chamber to return to a position in registration with said upper portion, said third seal means being in constant sealing engagement with said third rotor element to define a first cavity in said upper portion of said third chamber and a second cavity in said lower portion, said fourth seal means being in constant sealing engagement with said fourth rotor element to define a first cavity in said upper portion of said fourth chamber and a second cavity in said lower portion, and third and fourth heater-regenerator-cooler means to condition a working fluid through repeated Stirling cycles, said third heater-regenerator-cooler means operatively connected to said first cavities of said third and fourth chambers and said fourth heater-regenerator-cooler means operatively connected to said second cavities of said third and fourth chambers.

14. The machine of claim 1 wherein said crankshaft comprises a power output means and said heater-regenerator-cooler means are adapted to condition said working fluid through repeated Stirling cycles to rotate said crankshaft whereby said machine operates as a prime mover and said power output means provides rotational power.

15. The machine of claim 1 wherein said crankshaft comprises a power input means adapted to receive rotational power from a power source means and said heater-regenerator-cooler means are adapted to condition said working fluid through repeated Stirling cycles whereby said machine operates as a refrigeration device.

16. The method of using a rotary Stirling cycle machine as a refrigeration machine, said machine having at least chambers being epitrochoidal in cross sectional area, two rotor elements adapted to register with the upper and lower portion of said respective chambers, a crankshaft rotatably mounted within said chambers with said rotor elements rotatably mounted to said crankshaft so that said rotor elements planetarily rotate about said crankshaft within said respective chambers and a heater-regenerator-cooler means, the steps of the method comprising, applying rotational power to said crankshaft to rotate said crankshaft and said rotor elements, and conditioning a working fluid through repeated Stirling cycles so that said heater-regenerator-cooler means operates as a refrigeration coil means and heat rejection means, rotating said first chamber with respect to said second chamber to cause selective variance of the phase angle between the longitudinal axis of said second chamber and said first chamber.

* * * * *